United States Patent [19]

Plica et al.

[11] 4,433,944

[45] Feb. 28, 1984

[54] STRUCTURAL COMPONENTS FOR CONSTRUCTING A WALL

[75] Inventors: Peter Plica, Munich; Karl Schmöller, Haar; Gerd Dresp, Munich, all of Fed. Rep. of Germany

[73] Assignee: Dyckerhoff & Widmann Aktiengesellschaft, Munich, Fed. Rep. of Germany

[21] Appl. No.: 349,457

[22] Filed: Feb. 17, 1982

[30] Foreign Application Priority Data

Feb. 21, 1981 [DE] Fed. Rep. of Germany ..... 3106486

[51] Int. Cl.[3] ..... E02D 5/00

[52] U.S. Cl. ..... 405/284; 47/83; 405/272

[58] Field of Search ..... 405/284–287, 405/272–274; 47/82–86, 78, 75, 47

[56] References Cited

U.S. PATENT DOCUMENTS 1,268,649 6/1918 Velde ..... 47/83 X 4,244,665 1/1981 Neumann ..... 47/83 X 4,293,245 10/1981 Jaecklin ..... 405/284 X

FOREIGN PATENT DOCUMENTS 2727749 11/1979 Fed. Rep. of Germany ..... 47/83

*Primary Examiner*—Dennis L. Taylor

*Attorney, Agent, or Firm*—Toren, McGeady and Stanger

[57] ABSTRACT

Structural components for constructing a retaining wall, a noise barrier or similar structure are made up of a pair of horizontally extending generally parallel runner elements and connecting elements joining the runner elements together. The downwardly facing lower surface of each runner element has a concave curvature. The concave curvature is made up of a stepped surface which is higher at the outer side of the runner elements than at the inner side. Lines normal to the individual stepped surfaces intersect below the concave surface at a point. The structure components can be stacked one on the other to form a wall backfilled with earth or other material. Sound waves striking against the stepped surfaces are reflected into the slopes of the backfilled material between the individual components.

15 Claims, 7 Drawing Figures

STRUCTURAL COMPONENTS FOR CONSTRUCTING A WALL

SUMMARY OF THE INVENTION

The present invention is directed to an arrangement of structural components, such as prefabricated reinforced concrete members, for use in constructing a retaining wall, a sound or noise abatement wall or similar structure, formed in the manner of a grid with horizontally extending runner elements, preferably of a uniform depth, joined by connecting elements. Preferably, the connecting elements are disposed perpendicularly to the runner elements.

There is a known arrangement of structural components made up of runner elements and connecting elements used for constructing a retaining wall where the elements form a grid-like arrangement. In this known construction, the structural components include a plurality of runner elements extending horizontally and parallel to the plane of the wall with the runner elements resting on perpendicularly arranged connecting elements. The connecting elements extend into the backfill or structural fill used in forming the wall. The runner elements are supported by the connecting elements. Note Austrian patent 281,891. The backfill introduced into the grid-like arrangement of the structural components forms natural slopes in the spaces between the runner elements. Such a retaining wall can be used as a sound suppression wall, where the sound from a highway, upon reaching the underside of the horizontal runner elements. is reflected into the slope of the backfill.

In other known wall constructions formed of individual structural components, as disclosed in West German Offenlegungsschrift No. 26 46 020 and West German Offenlegungsschrift No. 29 23 631, each structural component is made up of two runner elements directed toward one another and joined by transversely extending connecting element forming frame-like structural units which can be stacked one on the other. By stacking a plurality of these structural components, a three-dimensional framework is produced which can be backfilled with earth and form a noise suppression wall along both of its sides.

In the structural components the sides of the runner elements facing outwardly of the retaining wall have an essentially convex shape so that a great part of the sound striking the wall is reflected in a diffused form back toward the source with only a relatively small portion of the sound being absorbed.

Therefore, it is the primary object of the present invention to provide an arrangement of the structural components of the general type described above which afford the possibility of absorbing the sound waves impinging against the wall while limiting the amount of the sound reflected away from the wall.

In accordance with the present invention, the runner elements forming the wall have concavely shaped downwardly facing surfaces arranged so that the inner portion of the concave surface is located below the outer portion relative to the outside surfaces of the retaining wall formed by the runner elements.

To achieve the desired purpose, the concavely shaped downwardly facing lower surface of the runner elements is formed in a step-like manner made up of a number of planar sections. Lines extending normal to the planar sections advantageously intersect in one point. The point of intersection of the lines is located adjacent the outer upper surface of the runner element of the next subjacent structural component, that is, the surface closer to the outer side of the retaining wall.

The runner elements have an approximately prismatic size with a cross sectional area similar to that of a triangle with the triangular cross-section defined by a generally horizontally extending top surface, a generally upwardly extending inside surface and a concavely curved downwardly facing lower surface extending between the other two surfaces.

In another embodiment, the runner elements can be constructed of an angular shape with one essentially horizontal side and one essentially vertical side. The concavely curved lower surface is provided by an insert piece placed into the open space formed by the two sides or legs of the runner element. Suitably, the insert piece is made of a sound-absorbent material.

A pair of runner elements with their generally upwardly extending inner surfaces facing one another can be interconnected by connecting elements to form a grid-like or frame-like structural component. The structural components can be stacked on one another in the vertical direction.

The ends of the runner elements can project outwardly from the connecting elements.

Preferably, recesses are formed in the structural components in the region of the intersection of the runner elements and the connecting elements for stacking the components one on another.

The particular advantage of the present invention over the prior art is considered to reside in the manner in which the downwardly facing lower surfaces of the runner elements are formed. Preferably, the lower surface is concavely curved and is made up of a number of planar step-like sections. The step-like sections, at least in part, have the appearance of an inverted stairway. When sound waves impinge on the downwardly facing lower surface of the runner elements they are reflected back down into the slope of the backfill between the vertically spaced runner elements with the backfill absorbing the sound waves. The only sound reflected back toward the source contacts the riser-like sections between the tread-like planar sections of the step-like concavely shaped lower surface. These riser-like sections are of a relatively small area as compared to the tread-like sections. Accordingly, a sound suppression wall equipped with runner elements formed in accordance with the present invention has a highly efficient sound or noise absorbent characteristic.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described preferred embodiments of the invention.

DETAIL DESCRIPTION OF THE INVENTION

Figure 1:
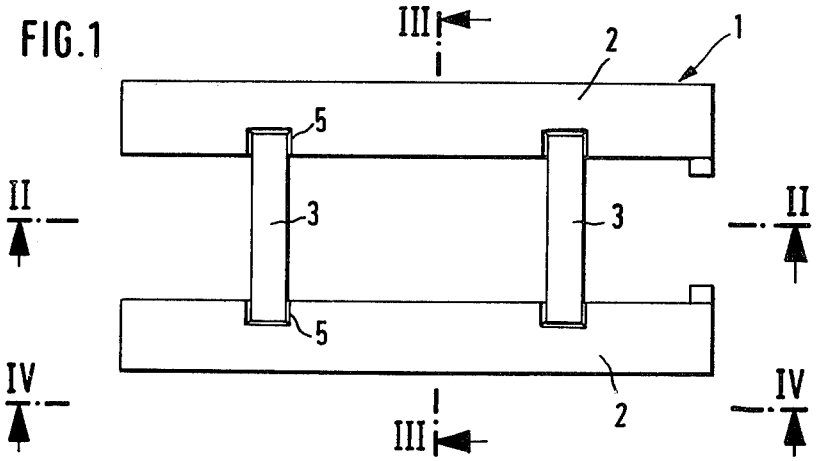
FIG. 1 is a top view of a structural component embodying the present invention.
Figure 2:
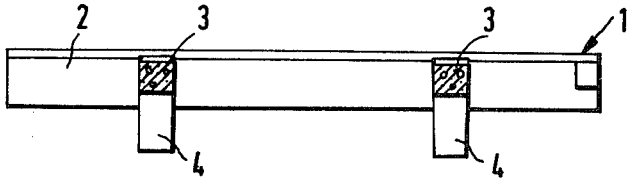
FIG. 2 is a longitudinal sectional view taken along the line II—II of FIG. 1.
Figure 3:
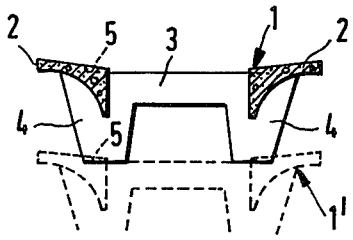
FIG. 3 is a transverse cross-sectional view taken along the line III—III in FIG. 1.
Figure 4:
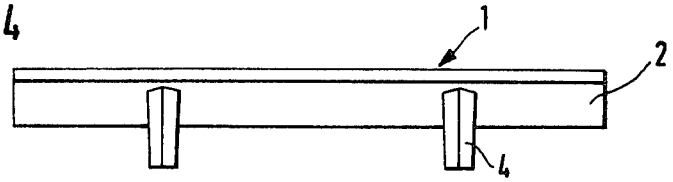
FIG. 4 is a side view taken in the direction IV—IV in FIG. 1.
Figure 7:
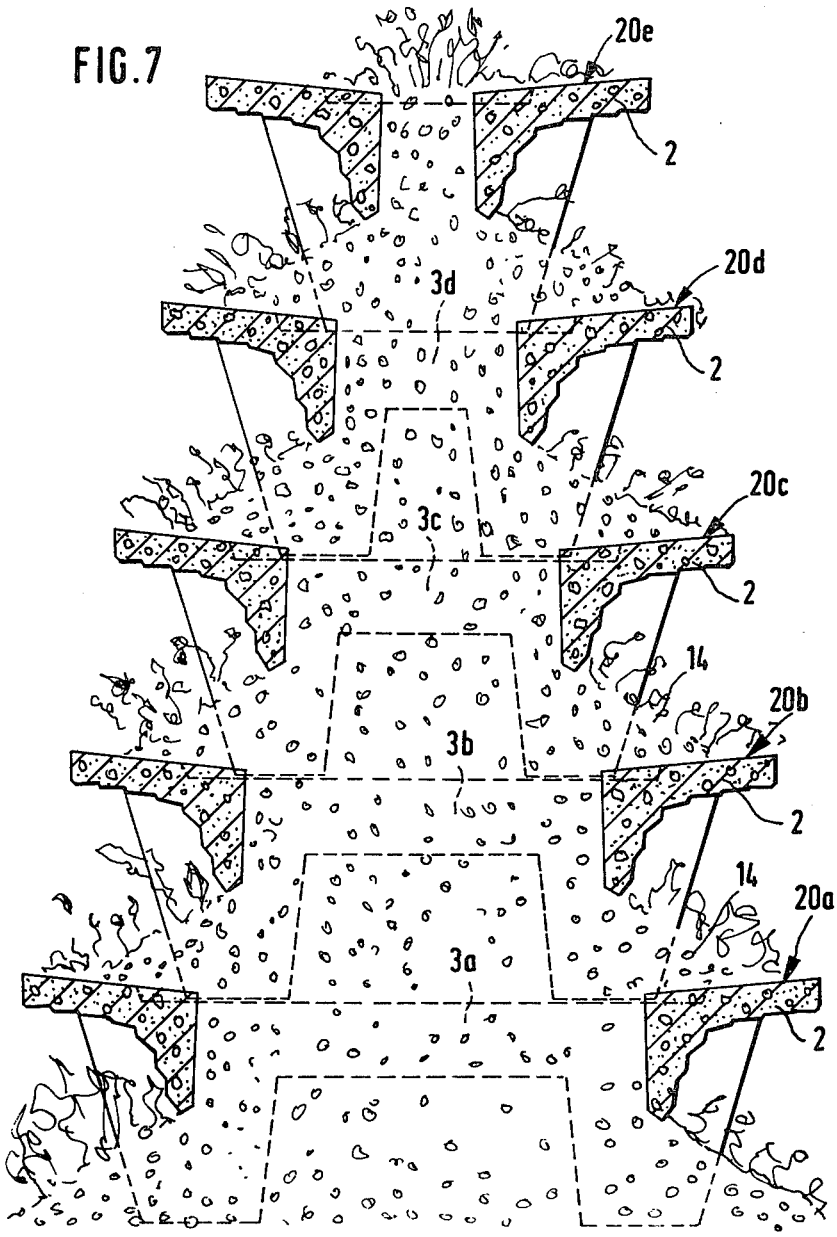
FIG. 7 is a transverse cross-sectional view of a sound suppression wall constructed of structural components embodying the present invention.

In FIG. 1 a structural component 1 is shown in plan view made up of a pair of parallel runner elements 2 joined together by a pair of connecting elements 3 forming a frame or grid member. In the use position the runner elements 2 and the connecting elements 3 extend horizontally. In the regions where the runner elements 2 and the binder elements 3 intersect foot-like spacers 4 are formed on the connecting elements and are shaped so that they can interengage with recesses 5 formed in the top side of the subjacent structural component 1', note FIG. 3. By vertically stacking a number of the structural components 1 with the width of the components decreasing in the height direction of the stack, that is, the width direction extends transversely of the long direction of the runner elements, a double-walled grid arrangement is provided so that the interior between the runner elements 2 can be filled with earth or other material. The wall formed by the structural components as the backfill has its outside surfaces sloping downwardly and outwardly between the vertically spaced runner elements 2, note FIG. 7. The backfill material is located between the runner elements 2 and slopes outwardly between the lower ends of a superjacent structural component 1 and the downwardly spaced upper surface of the runner elements in the subjacent structural component. The backfill material slopes outwardly to a point closely adjacent to the outside edges along the top surface of the subjacent runner elements 2. The top surface and outwardly sloping side surfaces of the backfill can be planted, as is indicated in FIG. 7. In place of a planted exterior surface, an absorbent material can be used as the exposed surface.

Figure 5:
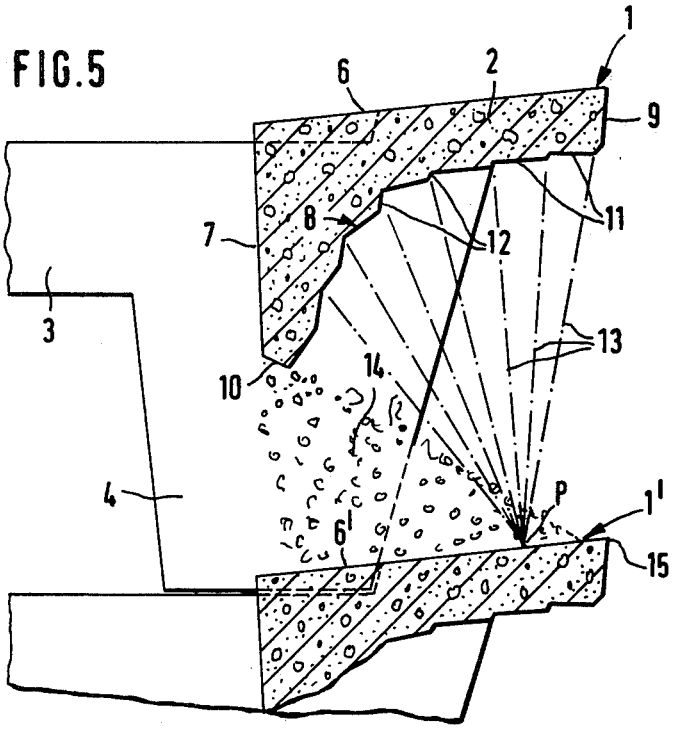
FIG. 5 is a detail cross-section of the structural component as shown in FIG. 3, but on a larger scale.

The significant feature of the invention is the special construction of the downwardly facing lower surface of the runner elements 2. The shape of the downwardly facing lower surface can best be seen in FIG. 5. In FIG. 5 an enlarged representation of the transverse cross-section of a runner element 2 is provided. As can be seen in the drawing the transverse cross-sectional area of the runner element is generally triangular in shape. In the use position of the structural component 1, the runner element 2 has a planar top surface 6 slightly inclined inwardly toward the other runner element with which it is paired. The upwardly extending inside surface 7 is also planar and is approximately vertical. The third side of the triangle is formed by the generally concavely shaped downwardly facing lower surface 8. To assure adequate strength for the opposite ends of the concavely curved surface 8, an upwardly extending outwardly facing edge face 9 extends upwardly from the surface 8 to the top surface 6 and a lower edge face 10 extends from the lower end of the inside surface 7 to the lower end of the curved downwardly facing lower surface 8. As can be seen in FIG. 5 the upper end of the lower surface 8 at the outside face 9 is spaced considerably upwardly from the intersection of the lower end of the lower surface 8 and the lower edge face 10. While the lower surface 8 has a generally concavely shaped surface, its surface might be described as being similar to an inverted stairway which is made up of a number of tread-like step sections 11 each with a planar surface joined by riser-like sections 12. The tread-like planar sections 11 are initially horizontally extending commencing at the outer edge face 9, however, as they proceed inwardly the sections 11 are disposed at an angle to the horizontal. The tread-like planar sections 11 are arranged so that lines 13 extending normal to their surfaces intersect at a point P spaced downwardly from the lower surface 8 approximately vertically downward from the outer edge face 9. Further, the intersection point P is located approximately in the horizontal top surface 6 of the next subjacent runner element 1'. The material 14 backfilled into the structural elements 1, 1' forms a natural slope angle extending outwardly from the lower edge face 10 spaced upwardly from the top surface 6 of the subjacent structural component 1 to approximately the outer edge 15 of the subjacent runner element. Accordingly, sound waves directed against the wall formed by the structural elements 1, even when approaching from a most unfavorable angle, that is closely past the outside edge 15 of the subjacent structural component 1, is deflected against the sloping backfill material where it is absorbed.

Figure 6:
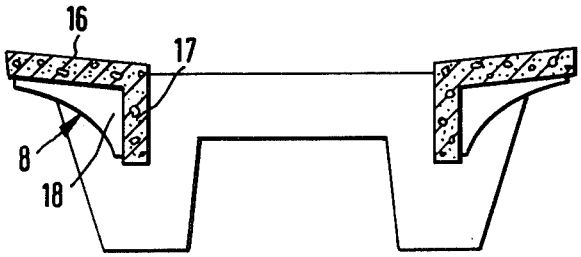
FIG. 6 is a cross-sectional view, similar to that in FIG. 3, illustrating another embodiment of a structural component incorporating the present invention.

Although the runner elements 2 illustrated in FIGS. 1 to 5 are constructed as massive concrete structural components, such as prefabricated reinforced concrete components, with a transverse cross sectional area resembling a triangle, it is also possible, for reasons of space economy, to construct the runner elements with a transverse angular cross-section as shown in FIG. 6. The angular cross-section is formed by an approximately horizontal leg 16 and an approximately vertical leg 17 with the concavely shaped downwardly facing lower surface 8 behind formed by an insert piece 18 secured in the angular opening formed between the legs 16 and 17. The insert piece 18 can be formed of a special sound-absorbent material such as a single-sized aggregate concrete, a synthetic plastics material or the like.

In FIG. 7 a practical embodiment of a sound suppressing wall is displayed made up of five structural components stacked one on the other providing a vertically extending wall. Each of the structural components is formed as described above, however, the width dimension, that is the dimension extending transversely of the long direction of the runner elements 2, decreases from the bottom of the wall upwardly. Each runner element 2 is constructed of the same dimensions. The differing width of the individual structural components 20*a* to 20*e* results from varying the length of the connecting elements 3*a* to 3*e*. For the most effective formation of the wall, the backfilling is carried out after each structural component is placed. Accordingly, after the lowest structural component 20*a* is set in place, it is filled to the height of the connecting elements 3*a* and then the next structural component 20*b* is superimposed upon it and again the backfilling takes place up to the top of the next connecting elements 3*b*. This procedure is continued until the uppermost structural component 20*a* is set in place.

While specific embodiments of the invention have been shown and described in detail to illustrate the application of the inventive principles, it will be understood that the invention may be embodied otherwise without departing from such principles.

We claim:

1. Structural components having a frame or grid-like structure are used for constructing a sound suppression barrier or the like with each said structural component comprising a pair of horizontally extending laterally spaced elongated runner elements, and connecting elements extend transversely of and interconnect said runner elements, each said runner element has a generally upwardly extending first surface facing toward said first surface on the other said runner element of said pair, a generally horizontally disposed second surface extending from said first surface outwardly away from the other said runner element of said pair, and a downwardly facing third surface extending from the lower end of said first surface to the outer end of said second surface, said third surface has a generally concave curvature extending between said first surface and said second surface with the end of the concavely curved third surface adjacent said second surface being located upwardly from the end of said concavely shaped third surface adjacent the lower end of said first surface so that said concavely shaped third surface faces outwardly away from said concavely shaped third surface of the other said runner element of said pair and also in the downward direction so that sound waves impinging on said concavely shaped third surfaces are reflected in the downward direction from said third surfaces and are not directed back toward the source of the sound waves.

2. Structural components, as set forth in claim 1, wherein said concavely shaped third surface has the appearance of an inverted stairway made up of alternating tread-like planar sections and riser-like planar sections extending in the elongated direction of said runner elements.

3. Structural components, as set forth in claim 2, wherein lines extending normally to said tread-like sections intersect at a point P located downwardly from said concavely shaped third surface.

4. Structural components, as set forth in claim 3, wherein the point of intersection of the lines normal to said tread-like planar sections is located approximately aligned below the outer edge of said second surface.

5. Structural components, as set forth in claim 3, wherein a plurality of said structural components are stacked one on the other forming a frame for a wall and with the point of intersection P of the lines normal to the tread-like planar sections of said third surface of each superjacent said structural component being located aligned below the outside edge of said second surface of the superjacent said runner element and approximately at the second surface of the subjacent said runner element.

6. Structural components, as set forth in one of claims 1 to 5, wherein each said runner element has an approximately prismatic shape with the transverse cross-sectional area being triangularly shaped defined by said first, second and third surfaces.

7. Structural components, as set forth in one of claims 1 to 5, wherein said runner elements have an angular shape with one approximately horizontally extending leg with the upper surface thereof forming said second surface, one generally vertically extending leg extending downardly from the inner end of said generally horizontally extending leg and the inwardly facing surface of said generally vertically extending leg forming said first surface, and an insert piece fitted into the angular space between said legs and said third surface being formed by the downwardly facing surface of said insert.

8. Structural components, as set forth in claim 7, wherein said insert piece is formed of a second-absorbent material.

9. Structural components, as set forth in claim 1, wherein said runner elements and said connecting elements form a frame-like structural member.

10. Structural components, as set forth in claim 9, wherein said runner elements and said connecting elements are shaped so that said structural components can be interfitted one on top of the other in a stacked arrangement.

11. Structural components, as set forth in claims 9 or 10, wherein said connecting elements are located between the opposite ends of said runner elements so that said runner elements project outwardly from said connecting elements.

12. Structural components, as set forth in claim 10, wherein said connecting elements have a greater height than said runner elements so that with the upper surfaces of said runner elements and connecting elements in approximately the same horizontal plane said connecting elements have foot-like spacers extending downwardly from the lower surface of said runner elements with each said foot-like spacers arranged to interfit with one of said runner elements of the subjacent said structural component.

13. Structural components, as set forth in one of claims 1–5, 8, 9 or 10, wherein a plurality of said structural components are stacked vertically one on top of the other forming a frame-like support for a wall, each said structural component located above another said structural component having a smaller width than the subjacent said structural component and said runner elements in each said structural component being of the same size and cross-sectional shape.

14. Structural components, as set forth in claim 1, wherein each said pair of runner elements and said connecting elements interconnecting said pair of runner elements form a frame-like structural member with said connecting elements projecting downwardly from said pair of runner elements which they interconnect, a plurality of said frame-like structural members are stacked one on top another to form a framework for a vertically extending wall so that soil can be filled into the framework for completing the wall, and in the stacked position the lower end of said connecting elements are in bearing contact with said runner elements of the subjacent said frame-like structural members.

15. Structural components, as set forth in claim 14, wherein said connecting elements of each said frame-like structural member have smaller dimension extending between said runner elements which they interconnect with respect to the subjacent said frame-like structural members so that said frame-like structural members are stepped inwardly in the vertical direction relative to the subjacent said frame-like structural members.

* * * * *